US005829358A

United States Patent [19]

Deaver

[11] Patent Number: 5,829,358

[45] Date of Patent: Nov. 3, 1998

[54] DUAL DUROMETER GASKET FOR A RAILROAD HOPPER CAR

[75] Inventor: Ralph A. Deaver, Waverly, Tenn.

[73] Assignee: Central Sales & Service, Inc., Waverly, Tenn.

[21] Appl. No.: 768,527

[22] Filed: Dec. 18, 1996

[51] Int. Cl.[6] ..... B61D 7/00

[52] U.S. Cl. ..... 105/280; 105/282.2; 105/247; 105/424; 277/178; 220/378; 222/542

[58] Field of Search ..... 105/424, 247, 105/282.2, 280; 277/178, 180, 186, 207 R, 209, 211, 227, 229, 228; 222/542; 220/378

[56] References Cited

U.S. PATENT DOCUMENTS

| | | | |
|---|---|---|---|
| 2,739,001 | 3/1956 | Chiles | 277/180 |
| 3,342,501 | 9/1967 | Meyer | 277/180 |
| 3,542,382 | 11/1970 | Hagmann | 277/180 |
| 3,807,318 | 4/1974 | Chierici . | |
| 4,036,149 | 7/1977 | White . | |
| 4,280,706 | 7/1981 | Vorwerk . | |
| 4,428,585 | 1/1984 | Dugge . | |
| 4,441,724 | 4/1984 | Taylor | 277/180 |
| 4,691,928 | 9/1987 | Abele | 277/180 |
| 4,768,684 | 9/1988 | Dugge | 277/180 |
| 4,891,117 | 1/1990 | Gardner | 277/180 |
| 4,973,067 | 11/1990 | Fritz | 220/378 |
| 5,035,185 | 7/1991 | Schultz . | |
| 5,277,128 | 1/1994 | Zimmerle . | |
| 5,413,359 | 5/1995 | Latty | 277/180 |

*Primary Examiner*—Mark T. Le
*Attorney, Agent, or Firm*—S. T. Belsheim

[57] ABSTRACT

A gasket assembly for sealing between a gate assembly and the bottom opening of a railroad hopper car wherein the gate assembly has a peripheral flange, and a hopper car flange surrounds the bottom opening of the railroad hopper car. The gasket includes a central band with an interior edge and exterior edge. The central band is made of a relatively rigid material. The central band contains a plurality of holes therein. An interior band of relatively softer material is bonded to the central band adjacent to the interior edge thereof. An exterior band of relatively softer material is bonded to the central band adjacent to the exterior edge thereof. Upon the assembly of the gate assembly to the bottom opening of the railroad hopper car, the interior band and the exterior band are subjected to a compressive force wherein the extent of the deformation of the interior band and the exterior band being limited by portions of the central band to which the interior band and the exterior band are bonded.

33 Claims, 2 Drawing Sheets

DUAL DUROMETER GASKET FOR A RAILROAD HOPPER CAR

BACKGROUND

Railroad hopper cars typically contain large loads of bulk materials for transport via the railways from one location to another. While the cargo may vary, one typical type of cargo comprises plastic pellets. These plastic pellets are about one-quarter of an inch long by about one-eighth of an inch in diameter. These plastic pellets are used to make a wide variety of end products such as, for example, medicine bottles and automotive parts. The particular composition of the plastic pellets may vary from one load to the next load. It is thus very important to maintain the compositional integrity from one load of plastic pellets to the next load. It is also very important to maintain the compositional integrity of each load of cargo by protecting the load from contamination through external contaminants.

Heretofore, one way by which the compositional integrity of loads of plastic pellets has been compromised is through the use of a gasket that results in the creation of an ineffective seal between the gate assembly and the bottom opening of the railroad hopper car. These earlier gaskets, which are supposed to seal between the top flange of the gate vale assembly and the surface surrounding the bottom opening of the hopper car, have been made of one material such as, for example, rubber or thermoplastic. The compressive force caused by tightening the bolts to secure the gate assembly to the hopper car causes the earlier gaskets to extrude (or deform) in a direction generally perpendicular to the direction of the compressive force. Because the extent of the extrusion can be severe to where the gasket doubles its width, the severe extrusion of the gasket may result in a dissipation of the original compressive force. This results in a loss of the integrity of the seal between the gate assembly and the hopper car (e.g., the gate assembly may actually become loose relative to the hopper car), which will allow external contaminants to enter into the hopper car. It is undesirable to provide such a gasket that will allow external contaminants to enter into the hopper car.

Another way by which a load of plastic pellets has been contaminated is through the plastic pellets from a previous load. In this regard, the severe extrusion of the gasket under the compressive forces as discussed above is oftentimes in a direction toward the interior of the gate assembly. The presence of excess extruded or deformed gasket material adjacent to the top flange of the gate assembly and the surface surrounding the opening of the hopper car provides a location in which plastic pellets can migrate to during shipment. The use of a gasket with a bulbous portion toward the interior of the gate assembly, or a gasket which has too much material toward the interior of the gate assembly, also provides locations for the pellets to migrate.

The migration of the pellets is enhanced by their low coefficient of friction which makes it easy for the pellets to move relative to one another, especially under the influence of the vibration of the hopper car in transit. The tons of pressure from the weight of the load above the pellets near the gate assembly also facilitates the migration of the pellets. These plastic pellets may then remain entrapped after the normal cleaning of the hopper car between loads. Entrapped plastic pellets may then contaminate a subsequent load of plastic pellets. It is an undesirable condition to permit plastic pellets from an earlier load to remain entrapped in the hopper car so as to contaminate a subsequent load of plastic pellets.

It would thus be desirable to provide a gasket assembly that does not permit external contaminants to enter into the hopper car. It would also be desirable to provide a gasket assembly that does not extrude or deform to such an extent that it provides locations for the entrapment of plastic pellets after the normal cleaning of a hopper car between loads.

SUMMARY OF THE INVENTION

It is an object of the invention to provide an improved gasket assembly for sealing between the gate vale assembly and the bottom opening of a railroad hopper car.

It is another object of the invention to provide an improved gasket assembly for sealing between the gate assembly and the bottom opening of a railroad hopper car wherein the gasket assembly does not permit external contaminants to enter into the hopper car.

It is another object of the invention to provide an improved gasket assembly for sealing between the gate assembly and the bottom opening of a railroad hopper car wherein the gasket assembly does not provide locations for plastic pellets to remain entrapped after the normal cleaning of the hopper car between loads.

BRIEF DESCRIPTION OF THE DRAWINGS

The following is a brief description of the drawings which form a part of this patent application.

DETAILED DESCRIPTION

Figure 1:
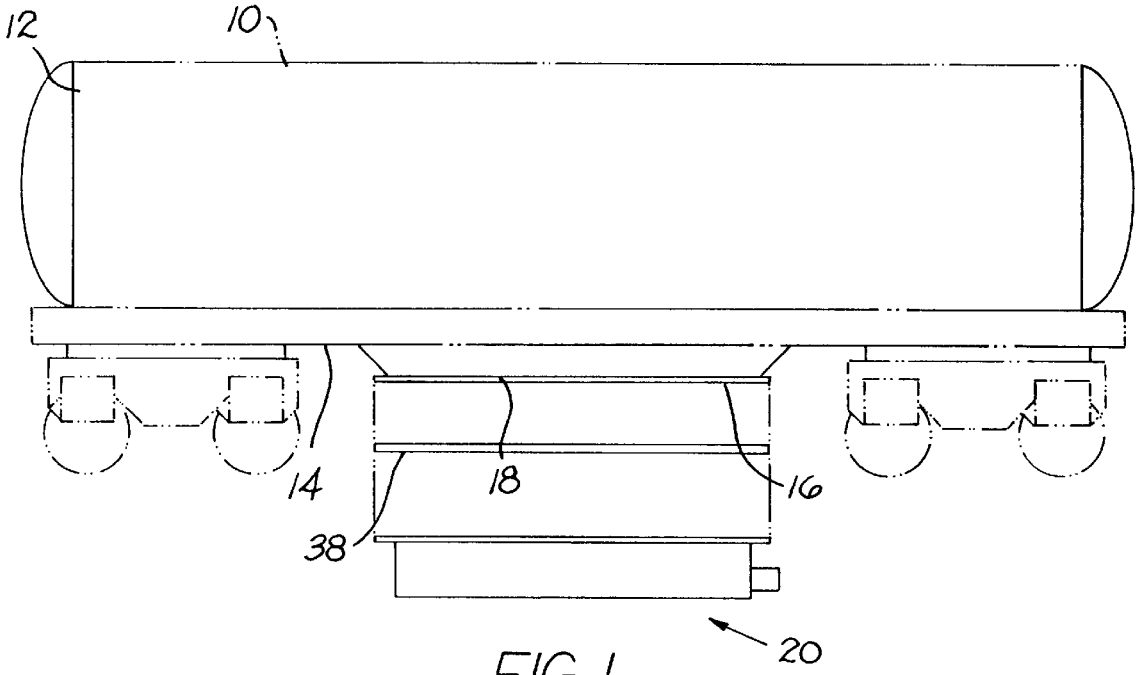
FIG. 1 is a side view of a railroad hopper car with a bottom opening and the gate assembly positioned below the opening.
Figure 2:
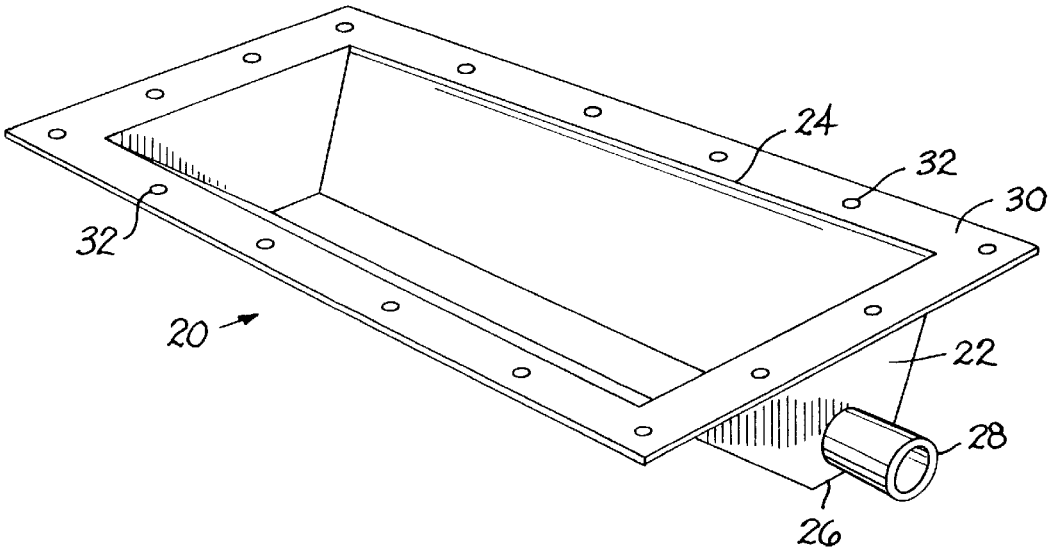
FIG. 2 is a isometric view of a gate assembly.
Figure 3:
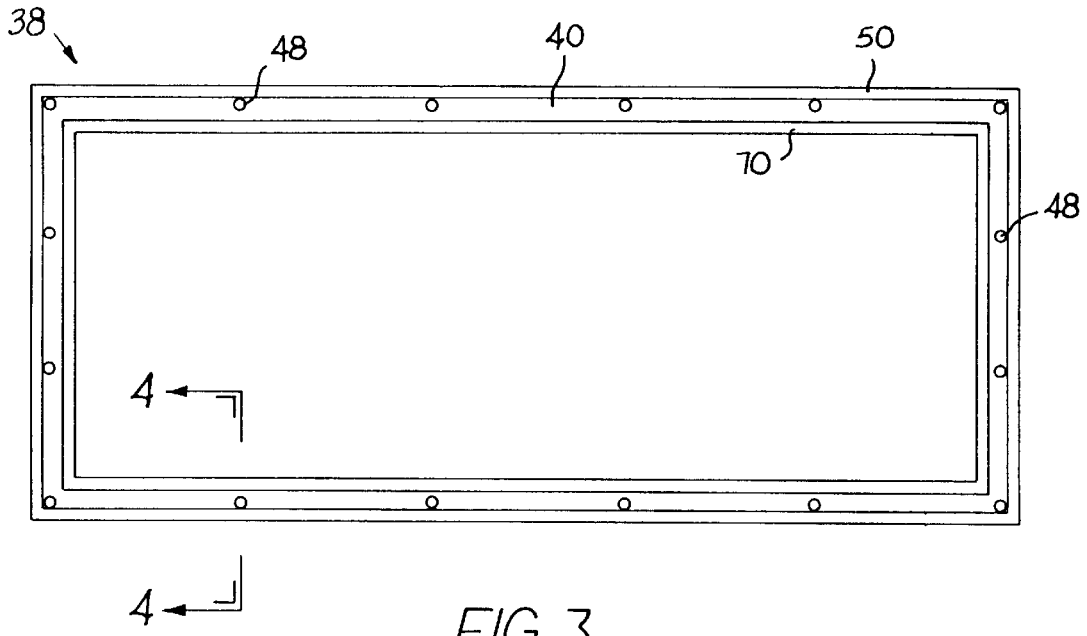
FIG. 3 is a top view of a specific embodiment of the gasket assembly of the invention.
Figure 4:
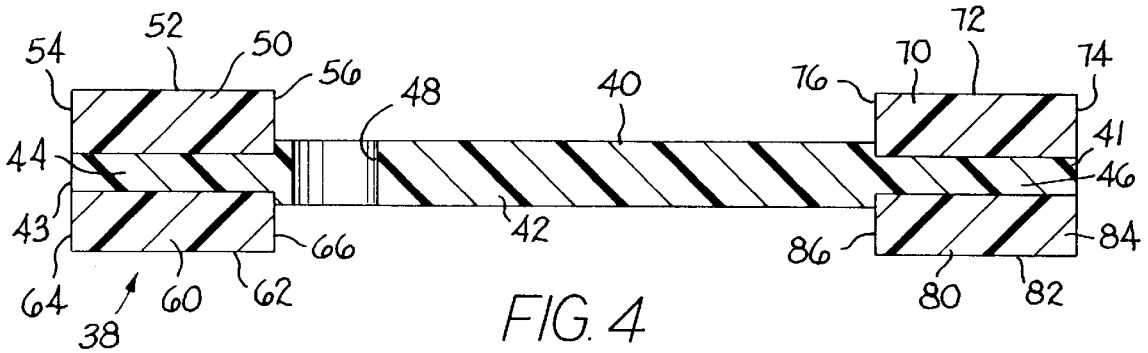
FIG. 4 is a cross-sectional view of the gasket assembly of FIG. 3 taken along section line 4—4.

Referring to the drawings, there is illustrated a railroad hopper car 10 which includes a tank section 12 which presents a bottom surface 14. The bottom surface 14 has an opening 16 therein wherein the opening 16 is defined by a generally rectangular flat surface 18. A gate assembly, generally designated as 20, connects to the bottom surface 14 of the hopper car 10 at the flat surface 18 via a plurality of bolts, as will be described hereinafter.

Gate assembly 20 includes a funnel section 22 with opposite top 24 and bottom 26 ends. There is a gate valve assembly 28 at the bottom end of the funnel 22 so as to control the flow of material out of the gate assembly 20. There is a generally rectangular flange 30 at the top end 24 of the funnel 22. Flange 30 contains a plurality of bolt holes 32. The size of flange 30 and the positioning of the bolt holes 32 therein correspond to the size of the flat surface 18 which also contains bolt holes 34 positioned so as to correspond with the bolt holes 32 in the flange 30.

A gasket assembly 38, which is of a generally rectangular shape, provides for a seal between the gate assembly 22 and the bottom opening 16 of the hopper car 10. Gasket assembly 38 includes a central band 40 which has an interior edge 41 and an exterior edge 43. The central band 40 also has a thick portion 42 and opposite thin portions 44 and 46.

Central band 40 is made of a rigid material such as, for example, PVC having a hardness of a 40 Durometer Shore D. Central band 40 contains a plurality of bolt holes 48 which correspond to the bolt holes 32 in the flange 30 of the gate assembly 20 and the bolt holes 34 in the flat surface 18 that surrounds to the bottom opening 16 in the hopper car 10.

Gasket assembly 38 further includes a top exterior band 50 which has an exposed top surface 52, an exterior edge surface 54, and an interior edge surface 56. Top exterior band 50 is firmly bonded to the top surface of the thin portion 44 of the rigid band 40. Gasket assembly 38 also includes a bottom exterior band 60 which has an exposed bottom surface 62, an exterior edge surface 64, and an interior edge surface 66. Bottom exterior band 60 is firmly bonded to the bottom surface of the thin portion 44 of the rigid band 40. The top exterior band 50 and the bottom exterior band 60 are each made from a soft material, such as, for example, PVC of 60 Durometer Shore A.

Gasket assembly 38 further includes a top interior band 70 which has an exposed top surface 72, an exterior edge surface 74, and an interior edge surface 76. Top interior band 70 is firmly bonded to the top surface of the interior thin portion 46 of the central band 40. Gasket assembly 38 further includes a bottom interior band 80 which has an exposed bottom surface 82, an exterior edge surface 84, and an interior edge surface 86. Bottom interior band 80 is firmly bonded to the bottom surface of the interior thin portion 46 of the central band 40. The top interior band 70 and the bottom interior band 80 are each made from a soft material, such as, for example, PVC of 60 Durometer Shore A.

As shown in FIG. 1, the gasket 38 is positioned so as to be between the flange 30 of the gate assembly 20 and the flat surface 18 that defines the bottom opening 16 in the hopper car 10. The bolt holes 48 in the gasket 38, the bolt holes 32 in the flange 30, and the bolt holes 34 in the the flat surface 18 all correspond so that a bolt 49 may pass through the holes (32, 34, 48) in all three structural members. The bolt 49 is tightened so as to compress the gasket 38 between the flat surface 18 and the opposing surface of the flange 30.

Figure 5:
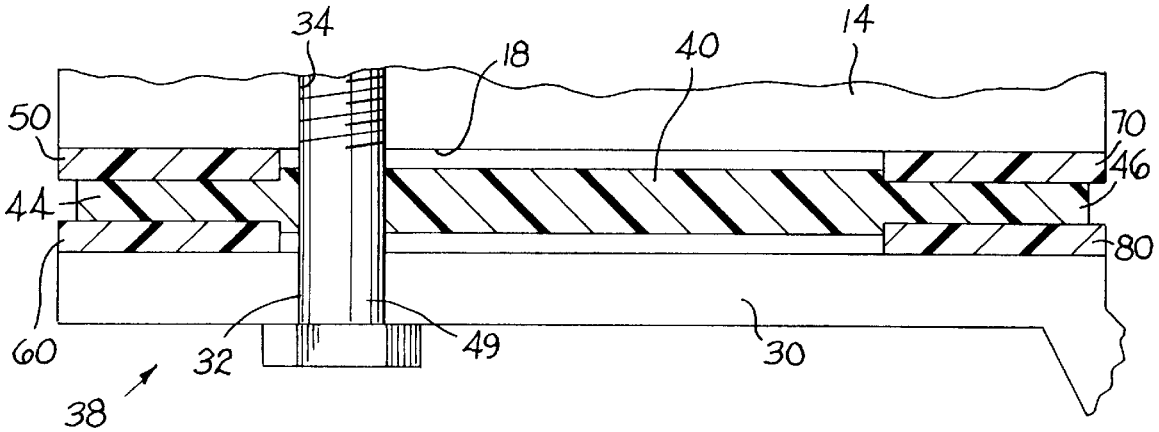
FIG. 5 is a cross-sectional view of the gasket assembly of FIG. 3 showing the compression thereof when the gate assembly is connected to the bottom opening of the hopper car.

Referring to FIG. 5, it can be seen that the compressive forces exerted on the gasket 38 cause the top exterior band 50, the bottom exterior band 60, the top interior band 70, and the bottom interior band 80 to compress and provide a seal between the flat surface 18 and the flange 30 of the gate assembly 20. It has been found that under thirty foot-pounds of compressive force, the portion of the gasket assembly that contains the interior and exterior bands, compresses down to a thickness of about ⅜th of an inch from an original thickness of 7/16ths of an inch. In this regard, each interior band and exterior band has a thickness of 5/32nd of an inch and the thin portion of the central band has a thickness of ⅛th of an inch. Each interior band and exterior band is ⅝th of an inch wide, the exterior and interior thin portions of the central bans are each ⅝th of an inch wide, and the entire central band is 3⅛ths inches wide.

However, the extend to which the top exterior band 50, the bottom exterior band 60, the top interior band 70, and the bottom interior band 80 expand is limited by the presence of the exterior and interior thin portions (44, 46) of the central band 40. This is because of the fact that the central band 40 is made from a rigid material which resists deformation due to the compressive forces exerted during the attachment of the gate assembly to the bottom opening of the hopper car. By limiting the extent of the deformation of the top exterior band 50, the bottom exterior band 60, the top interior band 70, and the bottom interior band 80, there will not be locations at which pellets can become lodged after a normal cleaning of a hopper car between loads. Furthermore, the limitation on deformation will inhibit the dissipation of compressive forces, and hence of any looseness, between the gate assembly and the bottom opening of the hopper car due to deformation of the gasket.

It thus becomes apparent that the present invention provides a number of advantages which have heretofore been unavailable. More specifically, the present invention provides a gasket that effectively seals between the gate assembly and the hopper car so as to not permit external contaminants to enter into the hopper car. This feature protects the compositional integrity of the load of material in the hopper car.

The gasket does not deform to a great extent over time so that the gasket inhibits the dissipation of compressive forces, and hence of any looseness, between the gate assembly and the hopper car due to gasket deformation. This feature also provides for a seal that protects the compositional integrity of the material in the hopper car.

It must also be appreciated that the present invention also provides a gasket that does not extrude to such an extent that it provides locations for the entrapment of plastic pellets after the normal cleaning of a hopper car between loads. This feature of where the gasket is non-extruding is important to maintaining the compositional integrity of the load. This is especially the case when one considers that entrapped plastic pellets are not visually perceivable in the course of the normal cleaning of the hopper between loads.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central band having interior and exterior edges, the central band being made of a relatively rigid material, and the central band containing a plurality of holes therein;

an interior band of relatively softer material, the interior band having an interior edge, the interior band being bonded to the central band adjacent to the interior edge of the central band so that the interior edge of the central band and the interior edge of the interior band define an interior edge of the gasket assembly;

an exterior band of relatively softer material, the exterior band having an exterior edge, the exterior band being bonded to the central band adjacent to the exterior edge of the central band so that the exterior edge of the central band and the exterior edge of the exterior band define an exterior edge of the gasket assembly; and upon the assembly of the gate assembly to the bottom opening of the railroad hopper car, the interior band and the exterior band being subjected to a compressive force wherein the extent of the deformation of the interior band and the exterior band being limited by portions of the central band to which the interior band and the exterior band are bonded.

2. The gasket assembly of claim 1 wherein the central band is made of PVC having a hardness of about 40 Durometer, Shore A.

3. The gasket assembly of claim 1 wherein the interior band is made of PVC having a hardness of about 60 Durometer, Shore D.

4. The gasket assembly of claim 3 wherein the exterior band is made of PVC having a hardness of about 60 Durometer, Shore D.

5. The gasket assembly of claim 1 wherein the central band includes an interior thin portion adjacent to the interior edge thereof, and the interior band being bonded to the central band at the interior thin portion thereof.

6. The gasket assembly of claim 1 wherein the central band includes an exterior thin portion adjacent to the exterior edge thereof, and the exterior band being bonded to the central band at the exterior thin portion thereof.

7. The gasket assembly of claim 1 wherein the central band includes an interior thin portion adjacent to the interior edge thereof, and an exterior thin portion adjacent to the exterior edge thereof; and the interior band being bonded to the central band at the interior thin portion thereof, and the exterior band being bonded to the central band at the exterior thin portion thereof.

8. The gasket assembly of claim 7 wherein the central band is made of PVC having a hardness of about 40 Durometer, Shore A, the interior band is made of PVC having a hardness of about 60 Durometer, Shore D, and the exterior band is made of PVC having a hardness of about 60 Durometer, Shore D.

9. The gasket assembly of claim 1 wherein when the exterior band and the interior band are subjected to the compressive force upon assembly of the gate assembly to the bottom opening, the interior band extends past the interior edge of the central band and the exterior band extends past the exterior edge of the central band.

10. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central band having interior and exterior edges, the central band being made of a relatively rigid material, and the central band containing a plurality of holes therein;

an interior band of relatively softer material bonded to the central band adjacent to the interior edge thereof;

an exterior band of relatively softer material bonded to the central band adjacent to the exterior edge thereof; and upon the assembly of the gate assembly to the bottom opening of the railroad hopper car the exterior band and the interior band are subjected to a compressive force so that the interior band extends past the interior edge of the central band and the exterior band extends past the exterior edge of the central band.

11. The gasket assembly of claim 10 wherein the central band includes an interior thin portion adjacent to the interior edge thereof, the interior band being bonded to the central band at the interior thin portion thereof, the central band having a thickness greater than the thickness of the interior thin portion so as to define an interior shoulder at the juncture thereof, and the interior band abutting the interior shoulder.

12. The gasket assembly of claim 10 wherein the central band includes an exterior thin portion adjacent to the exterior edge thereof, the exterior band being bonded to the central band at the exterior thin portion thereof, the central band having a thickness greater than the thickness of the exterior thin portion so as to define an exterior shoulder at the juncture thereof, and the exterior band abutting the exterior shoulder.

13. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central band having interior and exterior edges, the central band being made of a relatively rigid material, and the central band containing a plurality of holes therein;

an interior band of relatively softer material bonded to the central band adjacent to the interior edge thereof;

an exterior band of relatively softer material bonded to the central band adjacent to the exterior edge thereof; and upon completed assembly of the gate assembly to the bottom opening of the railroad hopper car, the interior band and the exterior band being subjected to a compressive force wherein the extent of the deformation of the interior band and the exterior band being such that the central band does not contact the gate assembly or the flat surface surrounding the bottom opening.

14. The gasket assembly of claim 13 wherein the interior band having an interior edge, the interior edge of the interior band and the interior edge of the central band defining an interior edge of the gasket assembly.

15. The gasket assembly of claim 14 wherein when the exterior band and the interior band are subjected to the compressive force upon assembly of the gate assembly to the bottom opening, the interior band extends past the interior edge of the central band.

16. The gasket assembly of claim 14 wherein the exterior band having an exterior edge, the exterior edge of the exterior band and the exterior edge of the central band defining an exterior edge of the gasket assembly, and when the exterior band and the interior band are subjected to the compressive force upon assembly of the gate assembly to the bottom opening, the exterior band extends past the exterior edge of the central band.

17. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central band having an interior edge and an exterior edge, the central band containing a plurality of holes therein;

an interior band having an interior edge, the interior band being a separate element bond to the central band adjacent to the interior edge of the central band, the interior edges of the interior band and central band define an interior edge of the gasket assembly;

the central band having a stiffness that is different from the stiffness of the interior band; and upon assembly of the gate assembly to the bottom opening of the railroad hopper car, the interior band being subjected to a compressive force.

18. The gasket assembly of claim 17 wherein the central band includes a top surface and a bottom surface, and the interior band being adjacent to the top surface.

19. The gasket assembly of claim 17 wherein the central band includes a top surface and a bottom surface, and the interior band being adjacent to the bottom surface.

20. The gasket assembly of claim 17 wherein the central band having an interior portion adjacent the interior edge thereof, the central band further having a central portion integral with the interior portion, and the interior portion of the central band being of a different thickness than the thickness of the central portion of the central band.

21. The gasket assembly of claim 17 wherein the central band defines a shoulder, and the interior band abutting the shoulder.

22. The gasket assembly of claim 17 wherein the central band having an interior portion adjacent the interior edge thereof and an exterior portion adjacent to the exterior edge thereof, the central band further having a central portion integral with the interior portion and the exterior portion, and upon assembly of the gate assembly to the bottom opening of the railroad hopper car, the central portion of the central band does not contact the gate assembly or the flat surface surrounding the bottom opening.

23. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central region, an interior region, and an exterior region, the central region being mediate between the exterior region and the interior region, the thickness of the central region being less than the thickness of the interior region, and the interior region defining the interior edge of the gasket assembly; and the interior region comprising a plurality of discrete portions attached together, and the stiffness of a first discrete portion being greater than the stiffness of a second discrete portion, each of said plurality of discrete portions having a surface defining part of an interior edge surface of the gasket assembly.

24. The gasket assembly of claim 23 wherein the thickness of the central region is less than the thickness of the exterior region.

25. The gasket assembly of claim 23 wherein the interior region comprises a core portion which is integral with the central region, and an interior band being attached to the core portion.

26. The gasket assembly of claim 25 wherein the core portion has a top surface and a bottom surface, and the interior band being attached to the top surface.

27. The gasket assembly of claim 25 wherein the core portion has a top surface and a bottom surface, and the interior band being attached to the bottom surface.

28. The gasket assembly of claim 25 wherein the core portion defines a shoulder, and the interior band abutting the shoulder.

29. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central region, an interior region, and an exterior region, the central region being mediate between the exterior region and the interior region, the thickness of the central region being less than the thickness of the interior region, the thickness of the central region being less than the thickness of the exterior region, and the interior region defining the interior edge of the gasket assembly;

the interior region comprising a plurality of discrete portions attached together, and the stiffness of a first discrete portion being greater than the stiffness of a second discrete portion; and upon completed assembly of the gate assembly to the bottom opening of the railroad hopper car, the interior region contacts the peripheral flange of the gate assembly and the flat surface surrounding the bottom opening, and the central region does not contact the gate assembly or the flat surface surrounding the bottom opening.

30. The gate assembly of claim 29 wherein upon assembly of the gate assembly to the bottom opening of the railroad hopper car, the exterior region contacts the peripheral flange of the gate assembly and the flat surface surrounding the bottom opening.

31. A gasket assembly arranged between a gate assembly and the bottom opening of a railroad hopper car wherein the gate assembly has a peripheral flange, and a flat surface which surrounds the bottom opening of the railroad hopper car, the gasket assembly comprising:

a central band having interior and exterior edges, the central band being made of a relatively rigid material, the central band containing a plurality of holes therein, and the central band having a top surface and a bottom surface;

a top interior band of relatively softer material, the top interior band having an top interior edge, the top interior band being bonded to the top surface of the central band adjacent to the interior edge thereof;

a bottom interior band of relatively softer material, the bottom interior band having an bottom interior edge, the bottom interior band being bonded to the bottom surface of the central band adjacent to the interior edge thereof;

the interior edge of the central band, the interior edge of the top interior band, and the interior edge of the bottom interior band define an interior edge of the gasket assembly; and upon the assembly of the gate assembly to the bottom opening of the railroad hopper car, the top interior band and the bottom interior band being subjected to a compressive force wherein the extent of the deformation of the top interior band and the bottom interior band being limited by portions of the central band to which the top interior band and the bottom interior are bonded.

32. The gasket assembly of claim 31 wherein upon the assembly of the gate assembly to the bottom opening of the railroad hopper car the top interior band and the bottom interior band are subjected to the compressive force so that the top interior band and the bottom interior band extend past the interior edge of the central band.

33. The gasket assembly of claim 31 wherein upon the assembly of the gate assembly to the bottom opening of the railroad hopper car the top interior band and the bottom interior band are subjected to the compressive force so that the central band does not contact the gate assembly of the flat surface surrounding the bottom opening.

* * * * *